US009089020B2

(12) United States Patent
Watanabe et al.

(10) Patent No.: US 9,089,020 B2
(45) Date of Patent: Jul. 21, 2015

(54) DIMMING SIGNAL GENERATION DEVICE AND ILLUMINATION CONTROL SYSTEM USING SAME

(75) Inventors: Koji Watanabe, Kyoto (JP); Hiromitsu Mizukawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 134 days.

(21) Appl. No.: 13/459,493

(22) Filed: Apr. 30, 2012

(65) Prior Publication Data

US 2012/0299512 A1 Nov. 29, 2012

(30) Foreign Application Priority Data

May 23, 2011 (JP) ..... 2011-115250

(51) Int. Cl.
*H05B 33/08* (2006.01)

(52) U.S. Cl.
CPC ..... *H05B 33/0815* (2013.01)

(58) Field of Classification Search
CPC ..... H05B 33/0815
USPC ..... 315/291, 307, 247, 224, 225, 185 S, 315/308–312
See application file for complete search history.

(56) References Cited

U.S. PATENT DOCUMENTS

| | | | |
|---|---|---|---|
| 2006/0279228 | A1 | 12/2006 | Kato |
| 2011/0057576 | A1 | 3/2011 | Otake et al. |
| 2011/0057577 | A1 * | 3/2011 | Otake et al. ..... 315/291 |

FOREIGN PATENT DOCUMENTS

| | | | |
|---|---|---|---|
| CN | 101960922 | A | 1/2011 |
| CN | 101971703 | A | 2/2011 |
| DE | 10162941 | C1 | 8/2003 |
| EP | 2257129 | A1 | 12/2010 |
| JP | H2-284381 | | 11/1990 |
| JP | H3-57196 | | 3/1991 |
| JP | 2008-311187 | A | 12/2008 |
| JP | 2010-287372 | A | 12/2010 |
| JP | 46361402 | | 2/2011 |
| WO | 2011/029194 | A1 | 3/2011 |

OTHER PUBLICATIONS

Chinese Office Action dated Mar. 4, 2014 issued in corresponding Chinese application No. 2012101290197, the English translation of the Search Report, and the English translation thereof.
Japanese Office Action dated Dec. 9, 2014 issued in corresponding Japanese application No. 2011-115250 and the English summary thereof.
Extended European Search Report dated Mar. 18, 2015 issued in corresponding European application No. 12 00 3001.0.
Japanese Office Action dated Apr. 14, 2015 issued in corresponding Japanese application No. 2011-115250 and English summary thereof.

* cited by examiner

*Primary Examiner* — Tuyet Vo
(74) *Attorney, Agent, or Firm* — Bacon & Thomas, PLLC

(57) ABSTRACT

A dimming signal generation device outputs a square wave voltage signal having an on-duty corresponding to a dimming level to a dimming signal line from a time point when a predetermined time period has elapsed after power-up. In the dimming signal generation device, a specific voltage is outputted to the dimming signal line for the predetermined time period after the power-up.

8 Claims, 6 Drawing Sheets

DIMMING SIGNAL GENERATION DEVICE AND ILLUMINATION CONTROL SYSTEM USING SAME

FIELD OF THE INVENTION

The present invention relates to a dimming signal generation device suitable for a solid-state light source lighting device for turning on a solid-state light source such as a light emitting diode (LED) and an illumination control system using the same.

BACKGROUND OF THE INVENTION

Conventionally, there has been proposed an LED lighting device which converts an AC power into a DC power to dim up and down an LED according to a dimming signal supplied from the outside (see, e.g. Japanese Patent Publication No. 4,636,102). In this conventional example, it is controlled such that the LED is turned on or off at a predetermined dimming level during a predetermined time period immediately after the supply of the AC power. After the lapse of the predetermined time period, the LED is dimmed up or down according to the dimming signal supplied from the outside.

Meanwhile, a dimming signal generation device which continuously outputs a dimming signal for a while even after power is cut off has been disclosed as the prior art in FIG. 2 of Japanese Patent Application Publication No. H3-57196. In FIG. 1 of Japanese Patent Application Publication No. H3-57196, as its improved technology, there is disclosed an embodiment of the dimming signal generation device that has been modified such that the dimming signal is blocked before a source voltage of a discharge lamp lighting device is attenuated after the power is cut off.

In the technology disclosed in Japanese Patent Publication No. 4,636,102, the LED can be controlled to be turned on or off at the predetermined dimming level during the predetermined time period immediately after the supply of AC power. However, in a case where a plurality of lighting devices are controlled by one dimming signal generation device as shown in FIG. 4, it was necessary to provide a countermeasure circuit to each lighting device, resulting in an increase in the cost of the entire illumination control system.

Further, in order to solve such problem of the illumination control system, there has been proposed modifying the dimming signal generation device rather than the lighting device in Japanese Patent Application Publication No. H3-57196. However, since the dimming signal generation device is used in combination with the discharge lamp lighting device that requires a preheating operation when the power supply is turned on, it was not a configuration in which the dimming signal can be supplied immediately after the power supply is turned on.

SUMMARY OF THE INVENTION

In view of the above, the present invention provides a dimming signal generation device in which a light output more than a desired level is not generated immediately after power-up even when it is used in combination with a solid-state light source lighting device, and an illumination control system using the same.

In accordance with an aspect of the present invention, there is provided a dimming signal generation device which outputs a square wave voltage signal having an on-duty corresponding to a dimming level to a dimming signal line from a time point when a predetermined time period has elapsed after power-up, wherein a specific voltage is outputted to the dimming signal line for the predetermined time period after the power-up.

In the dimming signal generation device, the specific voltage may be a voltage corresponding to a lights-off state or a predetermined dimming state.

Preferably, the predetermined time period is longer than a start-up time period of a solid-state light source lighting device connected to the dimming signal line after power-up.

In accordance with another aspect of the present invention, there is provided an illumination control system including the dimming signal generation device as described above; and a solid-state light source lighting device which shares a power source with the dimming signal generation device, wherein the solid-state light source lighting device controls a solid-state light source such that an illuminance is lower as the on-duty cycle of the square wave voltage signal received via the dimming signal line increases.

With the present invention, even if it is used in combination with the solid-state light source lighting device having a short start-up time period after power-up, unpleasant flash does not occur immediately after power-up or in sudden power cut-off. Further, it is possible to dim a plurality of solid-state light source lighting devices using one dimming signal generation device, without increasing the overall cost of the illumination control system.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Figure 1:
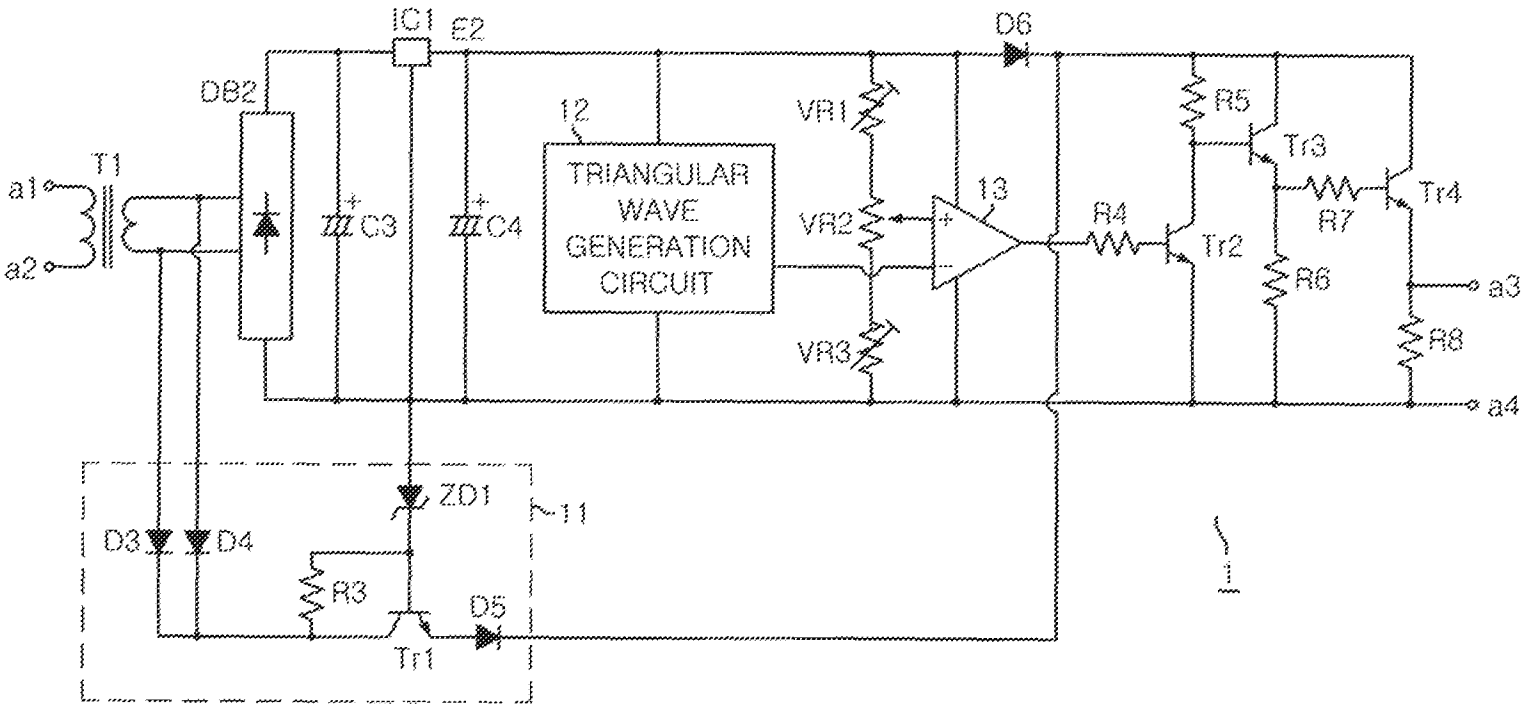
FIG. 1 is a circuit diagram of a dimming signal generation device in accordance with an embodiment of the present invention.

Hereinafter, an embodiment of the present invention will be described in more detail with reference to accompanying drawings which form a part hereof. Throughout the drawings, like reference numerals will be given to like parts.

FIG. 1 is a circuit diagram of a dimming signal generation device 1 in accordance with an embodiment of the present invention. A commercial AC power supply is connected to power supply terminals a1 and a2. Further, connected to dimming signal output terminals a3 and a4 are dimming signal input terminals b3 and b4 of a solid-state light source lighting device 2 via a dimming signal line 10 (see FIG. 4).

Figure 2:
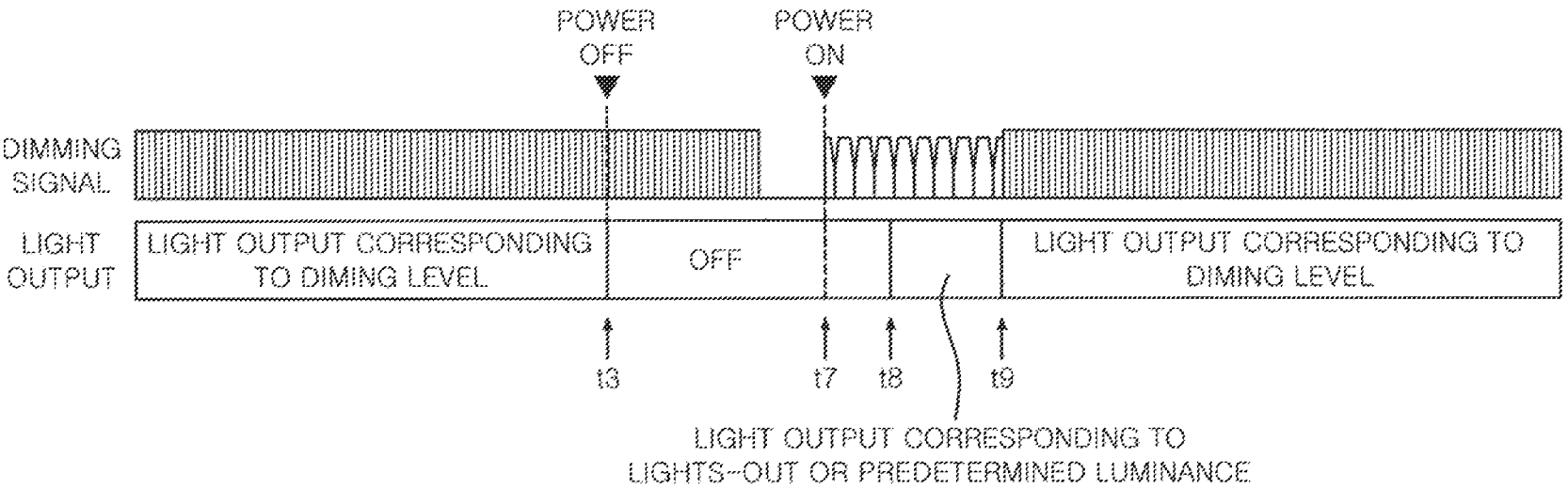
FIG. 2 is an explanatory diagram of an operation of the dimming signal generation device in accordance with the embodiment of the present invention.

A feature of the present embodiment is addition of a voltage output circuit 11 surrounded by a dashed line in FIG. 1. A portion except for the voltage output circuit 11 is the same as the conventional dimming signal generation device as shown in FIG. 2 of Japanese Patent Application Publication No. H3-57196. The dimming signal generation device outputs a square wave voltage signal having a duty cycle corresponding to a dimming level to the dimming signal line 10 from a time point (t9 of FIG. 2) when a predetermined time period has elapsed after the power supply is turned on (power-up). As shown in FIG. 1, the voltage output circuit 11 is a circuit which outputs a specific voltage to the dimming signal line 10 for a predetermined time period (t7-t9 of FIG. 2) after power-up.

Hereinafter, a circuit configuration of FIG. 1 will be described. An Ac voltage between the power supply terminals a1 and a2 is stepped down by a step-down transformer T1, and is full-wave rectified by a diode bridge DB2 to charge a capacitor C1. A voltage of the capacitor C3 is converted into a constant voltage by a three-terminal regulator IC1, and is charged in a capacitor C4 to serve as a DC power source E2 supplying a low DC voltage (e.g., about 12 V). A triangular wave generation circuit 12 being powered by the DC power source E2 applies a triangular wave voltage at a predetermined frequency (e.g., about 1 kHz) to an inverting input terminal of a comparator 13.

A voltage of the DC power source E2 is divided by a variable resistor VR2 and trimmer potentiometers VR1 and VR3 and is applied as a reference voltage to a non-inverting input terminal of the comparator 13. The trimmer potentiometers VR1 and VR3 are adapted to determine upper and lower limits of the reference voltage obtained from the variable resistor VR2.

An output terminal of the comparator 13 is connected to a base of a transistor Tr2 through a resistor R4. An emitter of the transistor Tr2 is connected to a negative electrode of the capacitor C4, and a collector of the transistor Tr2 is connected to a positive electrode of the capacitor C4 through a resistor R5 and also connected to a base of a transistor Tr3. A collector of the transistor Tr3 is connected to the positive electrode of the capacitor C4, and an emitter of the transistor Tr3 is connected so the negative electrode of the capacitor C4 through a resistor R6 and also connected to a base of a transistor Tr4 through a resistor R7. A collector of the transistor Tr4 is connected to the positive electrode of the capacitor C4, and an emitter of the transistor Tr4 is connected to the negative electrode of the capacitor C4 through a resistor R8. Then, a dimming signal is obtained from both terminals of the resistor R8.

In other words, the transistor Tr4 and the resistors R4 and R5 constitute a common-emitter inverting amplifier circuit. The transistor Tr3, the resistor R6, the transistor Tr4 and the resistors R7 and R8 constitute a common-collector (emitter follower) impedance conversion circuit.

Further, since the impedance conversion circuit is arranged at an output stage of the dimming signal generation device 1, it is possible to reduce an impedance in the dimming signal line even when the dimming signal line 10 connected between the solid-state light source lighting device 2 and the dimming signal generation device 1 becomes longer, which prevents attenuation of the dimming signal.

Next, an operation of the dimming signal generation device 1 will be described. If the triangular wave voltage outputted from the triangular wave generation circuit 12 is equal to or lower than the reference voltage, the output terminal of the comparator 13 becomes a high level. Accordingly, the transistor Tr2 is turned on, and the collector potential of the transistor Tr2 drops, so that the dimming signal becomes a low level.

On the other hand, if the triangular wave voltage outputted from the triangular wave generation circuit 12 is higher than the reference voltage, the output terminal of the comparator 13 becomes a low level. Accordingly, the transistor Tr2 is turned off, and the collector potential of the transistor Tr2 rises, so that the dimming signal becomes a high level. Thus, the dimming signal consisting of a square wave voltage signal is obtained.

Since the reference voltage can be set to a voltage ranging from a high voltage to a low voltage by operating the variable resistor VR2, an on-duty of the dimming signal can be set to a value ranging from a minimum value (e.g., 5%) to a maximum value (e.g., 95%).

Next, a circuit configuration of the voltage output circuit 11 that is the feature of the present invention will be described. Connected to an output terminal of the step-down transformer T1 are anodes of diodes D3 and D4. A constant-voltage circuit is provided between cathodes of the diodes D3 and D4 connected in common and a negative electrode of the diode bridge DB2, and the constant-voltage circuit includes a resistor R3, a Zener diode ZD1 and a transistor Tr1. An output of the constant-voltage circuit is inputted to a cathode of a diode D6 through a diode D5. The diodes D5 and D6 constitute an OR circuit such that an output voltage of the voltage output circuit 11 or an output voltage of the DC power source E2, whichever is greater, is supplied to the collectors of the transistors Tr3 and Tr4.

Herein, a Zener voltage of the Zener diode ZD1 is set to be slightly lower than the voltage of the DC power source E2, and, in a period during which the voltage of the DC power source E2 is low immediately after power-up, a voltage through the transistor Tr1 is supplied to the dimming signal output terminals a3 and a4 via the transistors Tr3 and Tr4. After that, when the voltage of the DC power source E2 rises and becomes stable, the diode DC becomes a cut-off state, and the dimming signal is generated by the voltage of the DC power source E2 supplied through the diode D6.

FIG. 2 is an explanatory diagram of the operation of this embodiment. Referring to FIG. 2, the power turns on at a time point t7. Immediately after that, a power supply voltage slightly lower than the voltage of the DC power source E2 is supplied from a cathode of the diode D5 via the voltage output circuit 11. Since the transistor Tr2 is not turned on until the voltage of the DC power source E2 is supplied at a time point t9 such that the triangular wave generation circuit 12 and the comparator 13 can operate, a voltage from the voltage output circuit 11 is outputted to the dimming signal output terminals a3 and a4 through the emitter follower circuit consisting of the transistors Tr3 and Tr4.

The voltage output circuit 11 has a feature that there is no time delay after power-up because it does not have the smoothing capacitors C3 and C4, unlike the DC power source E2, although there is a period during which a voltage is not outputted in the vicinity of the zero-cross of the AC power source. The output voltage of the voltage output circuit 11 has a voltage waveform in which a peak of the waveform of a ripple voltage obtained by stepping down and full-wave rectifying the AC power source is clamped by the Zener diode ZD1, and can be used as a pseudo PWM signal corresponding to a lights-out state or a predetermined low luminance lighting state although it has a low frequency (100 Hz or 120 Hz) compared to the frequency (1 kHz) of an original dimming signal.

With the dimming signal generation device 1 of the present invention, as shown in FIG. 2, the voltage of the voltage output circuit 11 is outputted to the dimming signal line 10 in a predetermined time period t7-t9 after power-up. Accordingly, even if the solid-state light source lighting device 2 begins to operate at a timing t8 of FIG. 2, the operation can be started in a lights-out state or a predetermined low luminance lighting state during a time period t8-t9, and unpleasant flash does not occur. That is, the predetermined time period t7-t9 is longer than a start-up time period t7-t8 of the solid-state light source lighting device 2.

Figure 3:
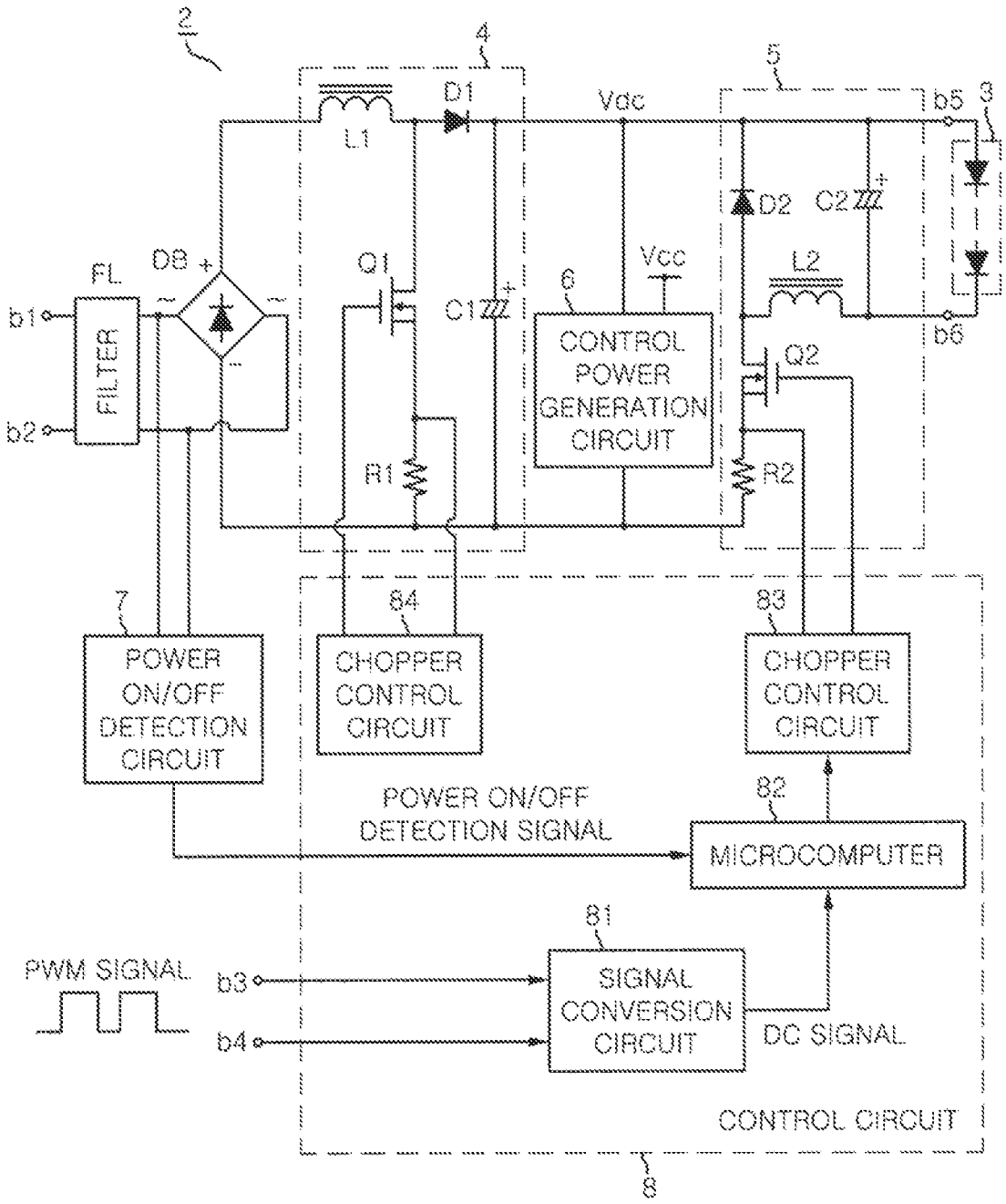
FIG. 3 is a circuit diagram of a solid-state light source lighting device used in combination with the dimming signal generation device in accordance with the embodiment of the present invention.

FIG. 3 illustrates a configuration of the solid-state light source lighting device 2 used in combination with the dimming signal generation device 1 shown in FIG. 1. Further, FIG. 4 illustrates an overall configuration of an illumination control system using the dimming signal generation device 1 shown in FIG. 1 and the solid-state light source lighting device 2 shown in FIG. 3.

Figure 4:
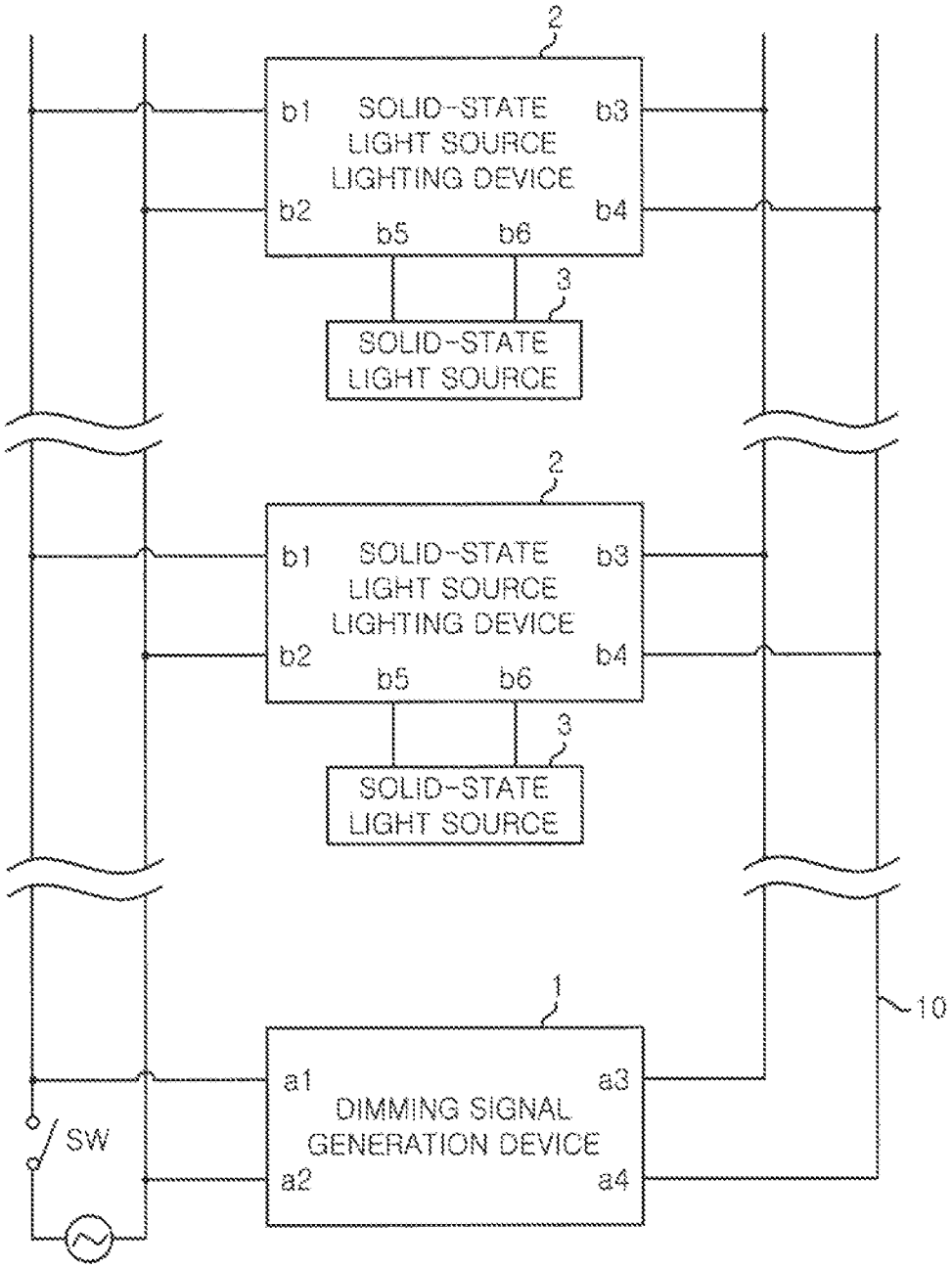
FIG. 4 is a circuit diagram showing an entire configuration of an illumination control system using the dimming signal generation device in accordance with the embodiment of the present invention.

The power supply terminals a1 and a2 of the dimming signal generation device 1 are connected to AC power lines and connected to a commercial AC power source Vs (e.g., AC 100 V, 50/60 Hz) through a power switch SW as shown in FIG. 4. Further, the dimming signal output terminals a3 and a4 of the dimming signal generation device 1 are connected to the dimming signal line 10 and connected to the dimming signal input terminals, b3 and b4 of the solid-state light source lighting device 2 as shown in FIG. 4.

The solid-state light source lighting device 2 includes, as shown in FIG. 3, power supply terminals b1 and b2, dimming signal input terminals b3 and b4, and load terminals b5 and b6. If a plurality of solid-state light source lighting devices 2 are controlled by one dimming signal generation device 1, as shown in FIG. 4, the power supply terminals b1 and b2 of each of the solid-state light source lighting devices 2 are connected to the power supply terminals a1 and a2 of the dimming signal generation device via the AC power lines, and the dimming signal input terminals b3 and b4 of each of the solid-state light source lighting devices 2 are connected to the dimming signal output terminals a3 and a4 of the dimming signal generation device 1 via the dimming signal line 10, The load terminals b5 and b6 of each of the solid-state light source lighting devices 2 are connected to each solid-state light source 3.

Hereinafter, a configuration of the solid-state light source lighting device 2 will be described. Connected to the power supply terminals b1 and b2 is a step-up chopper circuit 4 via a filter circuit FL and a full-wave rectifier DB. The step-up chopper circuit 4 includes a switching element Q1, an inductor L1, a diode D1, a smoothing capacitor C1 and a current detection resistor R1. The switching element Q1 is turned on/off at a high frequency by a chopper control circuit 84, so that a predetermined DC voltage Vdc is stored in the smoothing capacitor C1.

In the circuit configuration of FIG. 3, the step-up chopper circuit 4 and the chopper control circuit 84 may be omitted. Alternatively, the DC voltage Vdc may be generated by using only the smoothing capacitor C1.

The DC voltage Vdc of the smoothing capacitor C1 is converted by a step-down chopper circuit 5. The step-down chopper circuit 5 includes a switching element Q2, an inductor L2, a diode D2, a smoothing capacitor C2 and a current detection resistor R2. The switching element Q2 is turned on/off at a high frequency by a chopper control circuit 83, so that a DC voltage obtained by stepping down the input DC voltage Vdc is charged in the smoothing capacitor C2 and a DC current is supplied to the solid-state light source 3. The solid-state light source 3 is a semiconductor light emitting element such as a light emitting diode (LED) or organic electroluminescence (EL) element.

The chopper control circuit 83 is controlled by a microcomputer 82, and adjusts a light output of the solid-state light source 3 by varying an on-pulse width of the switching element Q2 according to the dimming signal, or lights of the solid-state light source 3 by stopping a switching operation of the switching element Q2.

In this embodiment, the step-down chopper circuit 5 is used as a switching circuit for controlling the DC current flowing in the solid-state light source 3. However, switching circuits having other configurations such as a flyback converter circuit, step-up chopper circuit, and step-up/step-down chopper circuit may be used.

The solid-state light source lighting device 2 shown in FIG. 3 is installed together with the solid-state light source 3 in an illumination apparatus. As shown in FIG. 4, the illumination apparatus has a dimming function in which dims up and down the solid-state light source 3 according no the dimming signal inputted from the dimming signal generation device 1 through the dimming signal line 10.

A plurality of illumination apparatuses, each including the solid-state light source lighting device 2 shown in FIG. 3, may be connected in parallel to the commercial AC power supply Vs as shown in FIG. 4. In this case, an illumination control system may be configured such that the dimming signal common to each of the illumination apparatuses is provided from the dimming signal generation device 1, and dimming of all the illumination apparatuses provided in the floor is controlled by the single dimming signal generation device 1.

The dimming signal transmitted via the dimming signal line 10 from the dimming signal generation device 1 is formed of, e.g., a square wave voltage signal having a frequency of about 1 kHz and amplitude of about 10 V. An on-duty (percentage of a high level period in one cycle) of the square wave voltage signal varies depending on the dimming level. For example, it is controlled such that if the on-duty ranges from 0 to x1 (%), the light output becomes 100% (full-lighting state), if the on-duty ranges from x1 to x2 (%), the light output decreases as the on-duty increases, and if the on-duty ranges from. x2 to 100 (%), the light output becomes 0%/((lights-out state). As described earlier (see, e.g., Japanese Patent Application Publication H3-57196), the dimming signal is widely used in the field of the inverter type fluorescent lamp lighting device. For example, x1 and x2 may be 5% and 95% (x1=5% and x2=95%).

As shown in FIG. 3, a control circuit 8 includes a signal conversion circuit 81, the microcomputer 82, the chopper control circuits 83 and 84. The signal conversion circuit 81 converts the dimming signal formed of the square wave voltage signal (PWM signal) with the variable on-duty into a DC voltage signal having an amplitude corresponding to the on-duty. The signal conversion circuit 81 includes, e.g., a waveform shaping circuit and a smoothing circuit.

The dimming signal transmitted via the dimming signal line 10 from the dimming signal generation device 1 is shaped by the waveform shaping circuit and smoothed by the smoothing circuit to be converted into the DC voltage signal. This DC voltage signal is inputted to the microcomputer 82 from an A/D conversion input terminal thereof and converted into a digital value. The microcomputer 82 includes a data table in an internal memory and sends to the chopper control circuit 83 a control signal of the light output corresponding to the digital value obtained by A/D conversion.

A power ON/OFF detection circuit 7 monitors a voltage between the power supply terminals b1 and b2, and generates a power ON/OFF detection signal to be inputted to the microcomputer 82 of the control circuit 8. The power ON/OFF detection circuit 7 does not determine the power OFF only by the zero-crossing of the AC source voltage across the power supply terminals b1 and b2. If the voltage across the power supply terminals b1 and b2 has continued to be at a low level for, e.g., several cycles to less than twenty cycles, the power OFF is determined to switch the state of the power ON/OFF detection signal.

A control power generation circuit 6 generates a control source voltage Vcc by using the DC voltage Vdc the smoothing capacitor C1, and supplies the control source voltage Vcc to the control circuit 8 and the power ON/OFF detection circuit 7. Even though the state of the power ON/OFF detection signal is switched to a state where the power OFF is detected by an OFF operation of the power switch SW, or a momentary voltage drop or outage in the AC power source Vs, the control source voltage Vcc is supplied while the DC voltage Vdc is outputted from the smoothing capacitor C1, and the control circuit 8 and the power ON/OFF detection circuit 7 are operable.

Figure 5:
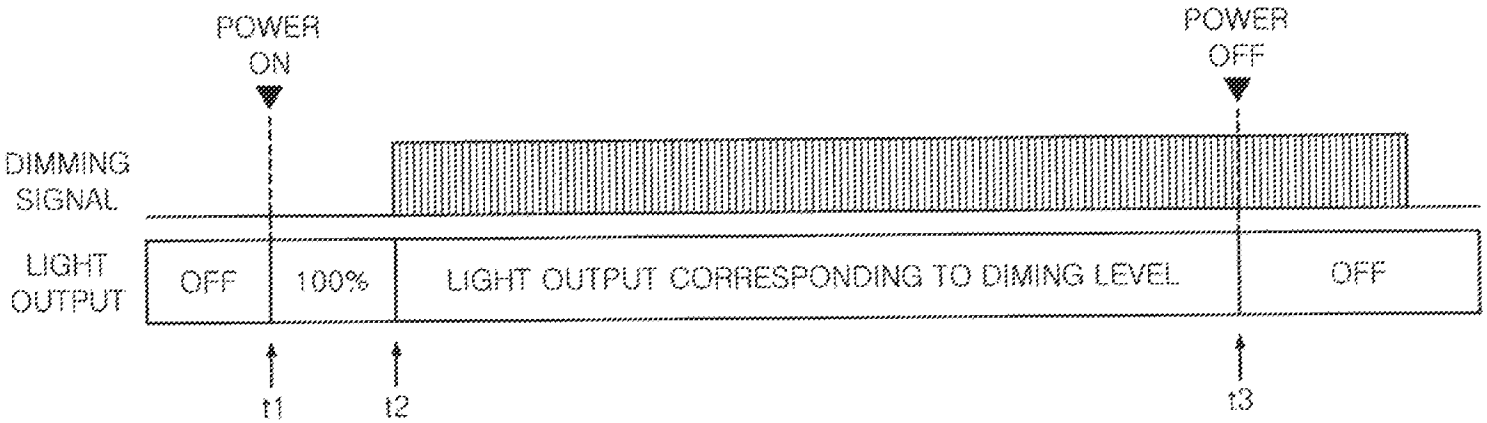
FIG. 5 is an explanatory diagram of an operation of a conventional example.
Figure 6:
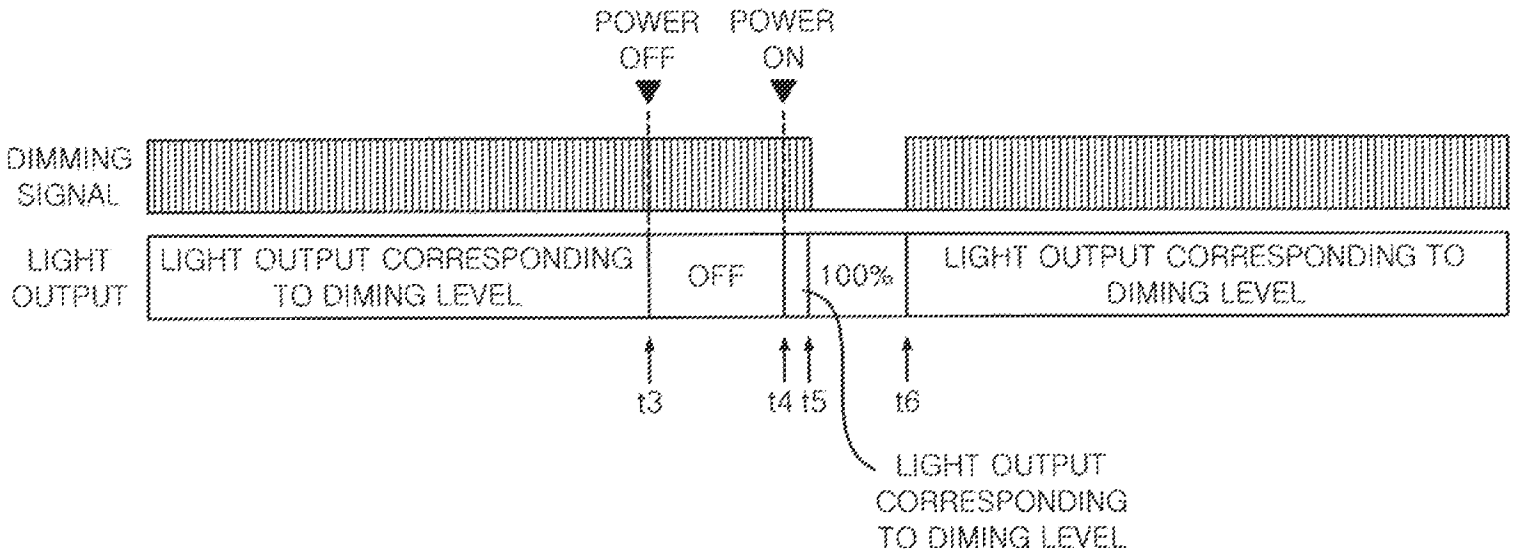
FIG. 6 is an explanatory diagram of the operation of the conventional example.

Since the AC power source Vs is shared by the dimming signal generation device 1, the output of the dimming signal is stopped when the power is OFF. However, since the dimming signal generation device 1 also has an internal power supply circuit (circuit consisting of the capacitors C3 and C4 and the three-terminal regulator IC1 as shown in FIG. 1), as shown in FIGS. 2, 5 and 6, the dimming signal disappears after a little time delay from the time when the power is OFF. Further, if no countermeasure circuit (voltage output circuit 11) as shown in FIG. 1 is provided, the dimming signal is generated after a little time delay (t1-t2 of FIG. 5, t4-t6 of FIG. 6) from the time when the power is ON.

FIG. 5 illustrates an operation when the power is ON and OFF in a conventional example in which no countermeasure is provided in accordance with she present invention. The solid-state light source 3 is turned off and the light output is 0% before the power ON. In this state, the dimming signal is not generated.

When the power is ON at the timing t1, the dimming signal generation device 1 connected to the common power source generates the dimming signal after a predetermined time period, i.e., at the timing t2. After the dimming signal occurs at the timing t2, the solid-state light source 3 is turned on at a light output corresponding to the dimming level specified by the dimming signal. When the power is OFF at the timing t3, the microcomputer 82 receives a power OFF detection signal and controls the solid-state light source 3 to be turned off immediately.

Here, what is concerned is the light output during the period t1-t2. The on-duty of the dimming signal is 0% until the dimming signal occurs at the timing t2 after the power ON is detected at the timing t1. In this case, the light output of the solid-state light source 3 is started from 100%. Accordingly, for example, even if a user performs an operation of the power ON by rotating a dimming knob of the dimming signal generation device 1 from at a low position (low light output), the light output of 100% is generated for a certain short period of time from the power ON.

In the conventional inverter type fluorescent lamp lighting device (see Patent Document 2), since a preheating period of filaments of the lamp is set for, e.g., about 1 second after power-up, there is no problem although the light output of 100% is set for a certain short period of time from the power ON, as mentioned above. It is rather preferable to start in the full-lighting state than starting in the dimming state in terms of the life of a hot cathode type discharge lamp. From this point of view, a dimmer designed to be suitable for the conventional inverter type fluorescent lamp lighting device generally has the specifications such that the dimming signal is not outputted (on-duty is set to 0%) for a short period of time corresponding to the preheating period of the fluorescent lamp after detecting the power ON.

However, in an LED dimming lighting device, there is no need for the preheating period during start-up as in the hot cathode type discharge lamp. Thus, the solid-state light source 3 can be turned on at a light output corresponding to the dimming level specified, by the dimming signal immediately after the power ON. Accordingly, there occurs a phenomenon (so-called "on-flash") in which the light source is momentary brightly lit, on when the power is turned on in the dimming state. A similar phenomenon may occur even in the momentary voltage drop or outage in the power source Vs.

FIG. 6 illustrates an operation of the momentary power outage in the conventional example in which no countermeasure is provided in accordance with the present invention.

At the timing t3, when the power OFF is detected, and the microcomputer 82 receives a power OFF detection signal, the microcomputer 82 controls the solid-state light source 3 to be turned of immediately. At the timing t4, when the power is restored, and the microcomputer 82 receives a power ON detection signal, the microcomputer 82 controls the solid-state light source 3 to be turned on at a light output corresponding to the dimming level of the dimming signal.

At the timing t5, when the on-duty of the dimming signal of the dimming signal generation device 1 becomes 0%, the light output becomes 100%. Then, after the dimming signal occurs at the timing t6, the solid-state light source 3 is turned on at a light output corresponding to the dimming level specified by the dimming signal.

Here, what is concerned is the light output during the period t5-t6. Since the on-duty of the dimming signal is 0% until the dimming signal occurs at the timing t6 after the dimming signal disappears at the timing t5, the light output of the solid-state light source 3 becomes 100%. Accordingly, when the power is restored after a brief outage of the power source Vs while the dimming state is carried out, there occurs a phenomenon in which the light source is briefly brightly lit on.

In order to solve this problem, the present invention is characterized in that, as shown in FIG. 2, a specific voltage is outputted to the dimming signal line 10 for a predetermined time period t7-t9 after power-up.

By doing this, when the power is ON at the timing t7 and the operation of the solid-state light source lighting device 2 is started at the timing t8 in FIG. 2, the operation can be started in the lights-out state or the dimming state corresponding to the predetermined low luminance during the time period t8-t9, and unpleasant flash does not occur. Further, even if the power is restored in a short period of time after the power is OFF at the timing t3 in FIG. 2, there does not occur a phenomenon in which the light source is briefly brightly lit on.

For example, in a case where the voltage output circuit 11 of FIG. 1 is not provided, if the power is turned off at the timing t3 and the power is restored at the timing t4 as shown in FIG. 6, the light source is turned on at a light output corresponding to the dimming level in the time period t4-t5. However, since the dimming level becomes 100% in the time period t5-t6, the momentary flash occurs.

However, in a case where the voltage output circuit 11 of FIG. 2 is provided, a specific voltage is outputted to the dimming signal line 10 during the time period t5-t6 of FIG. 6, as shown in the time period t7-t9 of FIG. 2. Accordingly, since the solid-state light source lighting device 2 operates at a light output of the lights-out state or the dimming state corresponding to the predetermined low luminance, unpleasant momentary flash does not occur.

Therefore, even if the power failure occurs while the light source is turned on in the dimming state and then the power is restored immediately, inconvenience caused by temporarily switching to the 100% lighting state does not occur.

In addition, it is preferred that the light, output is set at a predetermined dimming level at which the user does not feel the glare. Further, the light output is preferably set to be a low luminance dimming state which ensures a minimum brightness rather than a complete OFF state. Accordingly, especially in lighting control at night, it is possible to eliminate the anxiety of the user.

While the invention has been shown and described with respect to the embodiments, it will be understood by those skilled in the art that various changes and modification may be made without departing from the scope of the invention as defined in the following claims.

What is claimed is:

1. An illumination control system, comprising:

a dimming signal generation device which outputs a square wave voltage signal having an on-duty corresponding to a dimming level to a dimming signal line from a time point when a predetermined time period has elapsed after power-up, wherein a specific voltage is outputted to the dimming signal line for the predetermined time period after the power-up; and a plurality of solid-state light source lighting devices each of which receives the specific voltage and the square wave voltage signal via the dimming signal line such that the plurality of solid-state light source lighting devices are controlled by the dimming signal generation device.

2. The illumination control system of claim 1, wherein each of the solid-state light source lighting devices shares a power source with the dimming signal generation device, and wherein each of the solid-state light source lighting devices controls a solid-state light source such that an illuminance of the solid-state light source is lower as the on-duty cycle of the square wave voltage signal increases.

3. The illumination control system of claim 1, wherein the predetermined time period is longer than a start-up time period of a solid-state light source lighting device after power-up which is connected to the dimming signal line.

4. The illumination control system of claim 3, wherein each of the solid-state light source lighting devices shares a power source with the dimming signal generation device, and wherein each of the solid-state light source lighting devices controls a solid-state light source such that an illuminance of the solid-state light source is lower as the on-duty cycle of the square wave voltage signal increases.

5. The illumination control system of claim 1, wherein the specific voltage is a voltage corresponding to a lights-off state or a predetermined dimming state.

6. The illumination control system of claim 5, wherein each of the solid-state light source lighting devices shares a power source with the dimming signal generation device, and wherein each of the solid-state light source lighting devices controls a solid-state light source such that an illuminance of the solid-state light source is lower as the on-duty cycle of the square wave voltage signal increases.

7. The illumination control system of claim 5, wherein the predetermined time period is longer than a start-up time period of a solid-state light source lighting device after power-up which is connected to the dimming signal line.

8. The illumination control system of claim 7, wherein each of the solid-state light source lighting devices shares a power source with the dimming signal generation device, and wherein each of the solid-state light source lighting devices controls a solid-state light source such that an illuminance of the solid-state light source is lower as the on-duty cycle of the square wave voltage signal increases.

* * * * *